US008760361B2

(12) United States Patent
Lewry et al.

(10) Patent No.: US 8,760,361 B2
(45) Date of Patent: Jun. 24, 2014

(54) METHOD AND APPARATUS FOR FINE POLARIZATION REFLECTOR ANTENNA ADJUSTMENT

(75) Inventors: Matthew Lewry, Fife (GB); Junaid Syed, Fife (GB); Keith Tappin, Oakley (GB); Chris Hills, Fife (GB)

(73) Assignee: Andrew LLC, Hickory, NC (US)

( * ) Notice: Subject to any disclaimer, the term of this patent is extended or adjusted under 35 U.S.C. 154(b) by 434 days.

(21) Appl. No.: 12/885,619

(22) Filed: Sep. 20, 2010

(65) Prior Publication Data

US 2011/0074652 A1 Mar. 31, 2011

Related U.S. Application Data

(60) Provisional application No. 61/246,665, filed on Sep. 29, 2009.

(51) Int. Cl.
*H01Q 3/02* (2006.01)
*H01Q 1/12* (2006.01)
*H01Q 15/14* (2006.01)

(52) U.S. Cl.
USPC ..... 343/882; 343/878; 343/912

(58) Field of Classification Search
USPC ..... 343/878, 882, 892, 839, 840, 912, 916, 343/757, 761, 763, 834, 880, 915
See application file for complete search history.

(56) References Cited

U.S. PATENT DOCUMENTS

| | | | | |
|---|---|---|---|---|
| 2,955,288 | A | 10/1960 | Palmer | |
| 3,009,152 | A | 11/1961 | Gregory et al. | |
| 4,195,302 | A * | 3/1980 | Leupelt | 343/704 |
| 4,879,534 | A | 11/1989 | Spinner | |
| 4,888,596 | A * | 12/1989 | Conanan | 343/703 |
| 4,901,369 | A * | 2/1990 | Momose et al. | 455/84 |
| 5,508,712 | A | 4/1996 | Tom et al. | |
| 6,188,372 | B1 * | 2/2001 | Jackson et al. | 343/882 |
| 6,433,757 | B1 | 8/2002 | Shrader | |
| 6,985,057 | B2 | 1/2006 | Lesutis | |
| 7,113,144 | B2 * | 9/2006 | Lin et al. | 343/880 |
| 2010/0088911 | A1 | 4/2010 | Lewry et al. | |

FOREIGN PATENT DOCUMENTS

| | | |
|---|---|---|
| EP | 304656 | 1/1989 |
| GB | 2120856 | 12/1983 |
| WO | 9639726 | 12/1996 |

OTHER PUBLICATIONS

Extended European Search Report, related to application EP10181745.0, issued Jan. 18, 2011 by European Patent Office, Munich.

* cited by examiner

*Primary Examiner* — Hoang V Nguyen
*Assistant Examiner* — Patrick Holecek
(74) *Attorney, Agent, or Firm* — Babcock IP, PLLC

(57) ABSTRACT

A polarization adjustment assembly for a reflector antenna is provided with a radio bracket with a mounting flange. The mounting flange is coupled to a hub provided with a stop portion. Fasteners couple the radio bracket to the hub via slots in the mounting flange, rotatable with respect to the hub within the extents of the slots. An adjustment bolt passes through a boss coupled to the mounting flange. The adjustment bolt abuts the stop portion, whereby longitudinal displacement of the adjustment bolt with respect to the boss rotates the radio bracket with respect to the hub. Alternatively, the positions of the boss and stop portion on the mounting flange and hub may be exchanged.

19 Claims, 6 Drawing Sheets

METHOD AND APPARATUS FOR FINE POLARIZATION REFLECTOR ANTENNA ADJUSTMENT

BACKGROUND

1. Field of the Invention

This invention relates to reflector antennas. More particularly, the invention relates to a polarization adjustment assembly for a reflector antenna that enables fine polarization adjustment.

2. Description of Related Art

Reflector antennas are highly directional. In addition to being closely boresight aligned with one another, reflector antennas and feed components contained therein forming an RF communications link are rotationally aligned with respect to signal polarity.

Rotational alignment improves polarization isolation, a signal quality factor that becomes significant, for example, where multiple signals are being transmitted/received each on a separate polarity. Reflector antenna mounting upon non-vertical mounting points, such as angled tower struts, is often required, introducing a rotational mis-alignment generally corresponding to the angle of the mounting point away from vertical. Prior reflector antennas, for example as disclosed in WO96/39726 "System for fine antenna-aiming adjustment on three orthogonal axes", typically include fine adjustment capabilities incorporated into the mounting bracket. For polarization alignment, the system of WO96/39726 rotates the entire reflector antenna, including the reflector. Similarly, the system described in U.S. Pat. No. 6,433,757 "Antenna Polarization Adjustment Tool" provides a separate tool attachable to the antenna hub for general polarity alignment via rotation of the entire feed assembly.

Reflector antennas are typically installed at exposed locations high atop towers. Improved installation and/or maintenance personnel safety is a constant concern of the radio tower industry. Therefore, installation and/or adjustment procedures with a reduced number of steps and low installer force requirements are desired. Further, antenna specific tools are not desired as each additional tool presents an additional cost, separate drop hazard and ongoing inventory requirement.

Competition in the reflector antenna market has focused attention on improving electrical performance and minimizing overall manufacturing, inventory, distribution, installation and maintenance costs. Therefore, it is an object of the invention to provide a reflector antenna with a fine polarity adjustment capability that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventors have recognized that polarization adjustment configurations requiring rotation of the entire reflector antenna and/or entire feed assembly unnecessarily complicate fine polarization adjustment. Because of the increased mass of these assemblies, an adjustment slop and/or unacceptably high adjustment force requirement may be introduced. Precision of the adjustment mechanism may be compromised and/or costs increased in view of the increased force levels and/or machining precision required to accurately manipulate these assemblies. Further, when interconnections between the reflector antenna and mounting bracket or between a hub and a reflector are loosened to enable fine adjustment, boresight alignment of the antenna may be compromised, requiring numerous sequences of tightening, loosing, adjusting and retightening to observe the final signal result of each fine adjustment.

Figure 1:
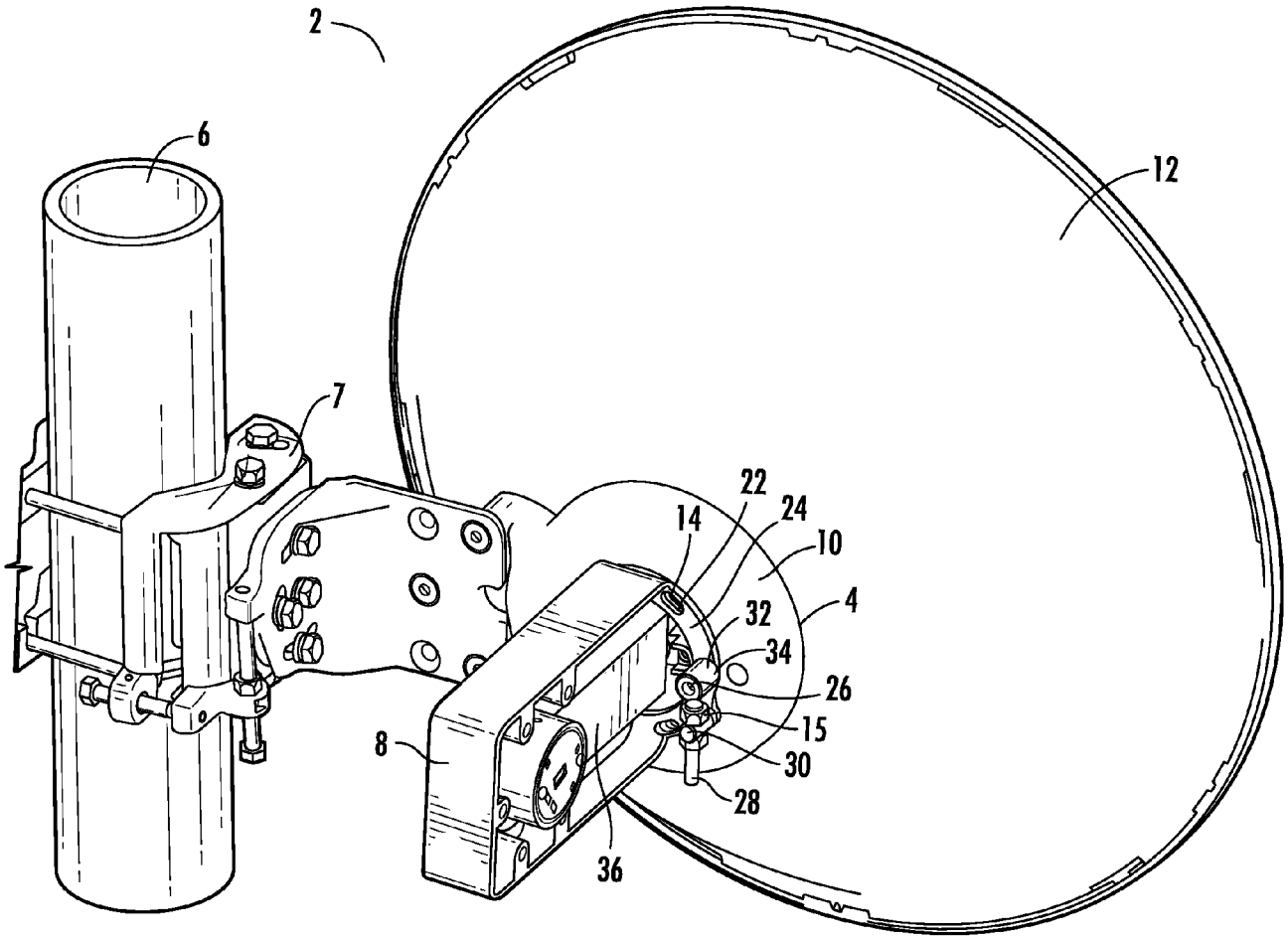
FIG. 1 is a schematic isometric angled back side view of a first embodiment of a reflector antenna mounted on a pole, fastener heads removed for clarity.
Figure 2:
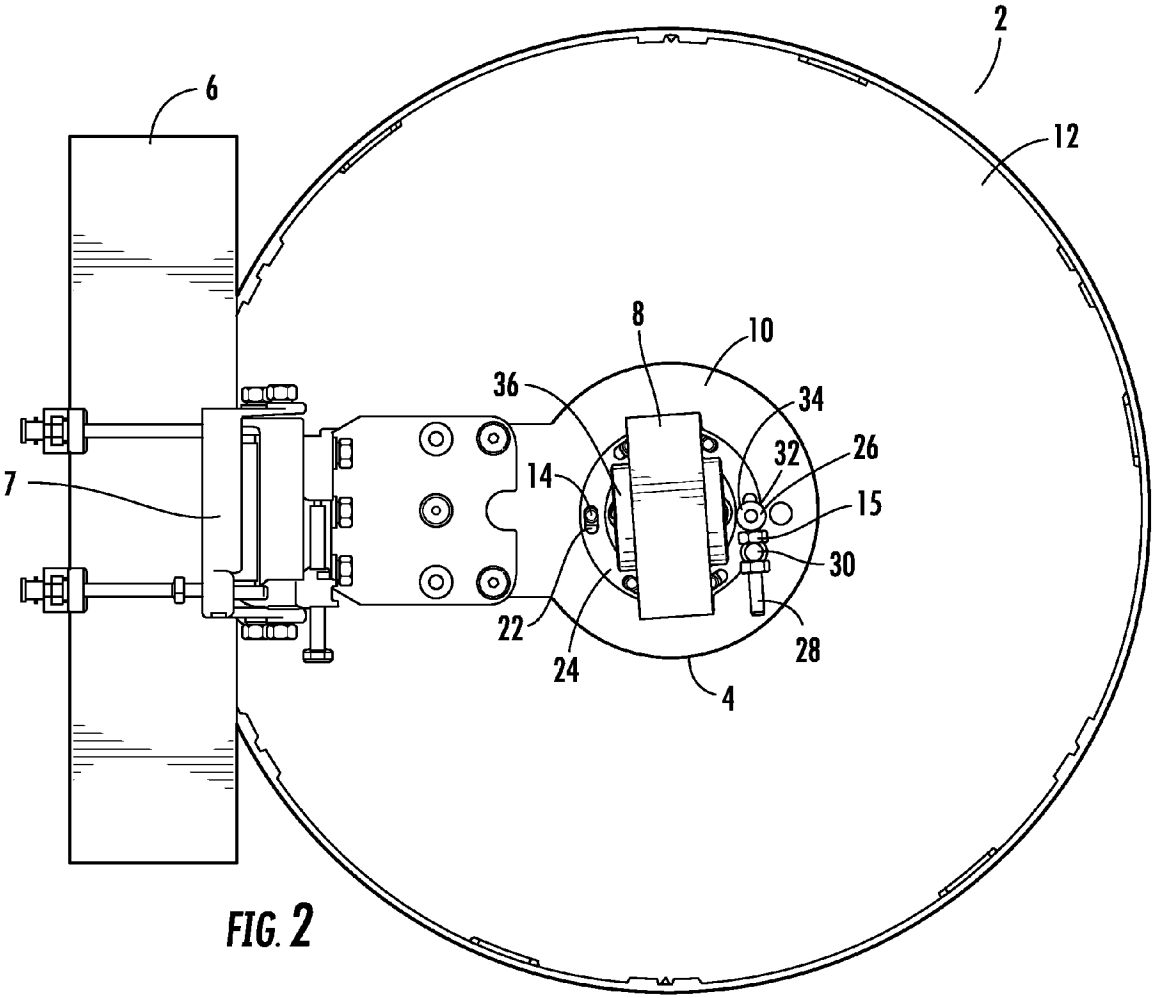
FIG. 2 is a schematic isometric back side view of a reflector antenna of FIG. 1, fastener heads removed for clarity.

A first exemplary embodiment of a reflector antenna 2 with a polarization adjustment assembly 4 is demonstrated in FIGS. 1-4. As best shown in FIGS. 1 and 2, the reflector antenna 2 is mountable upon a fixed mounting point 6 such as a pole or tower leg via a mounting bracket 7 coupled to a hub 10 of the reflector antenna 2. The hub 10 may be a separate element or an integral structure formed on the back side of the reflector 12 to which at least the radio bracket 8 is attached. The mounting bracket 7 includes fine boresight adjustment in azimuth and elevation directions via fasteners 14, for example bolts threadable in or out of corresponding nuts 15 or threaded portions, to pivot respective portions of the mounting bracket 7 and thereby the attached reflector antenna 2 in the desired direction/orientation.

Figure 3:
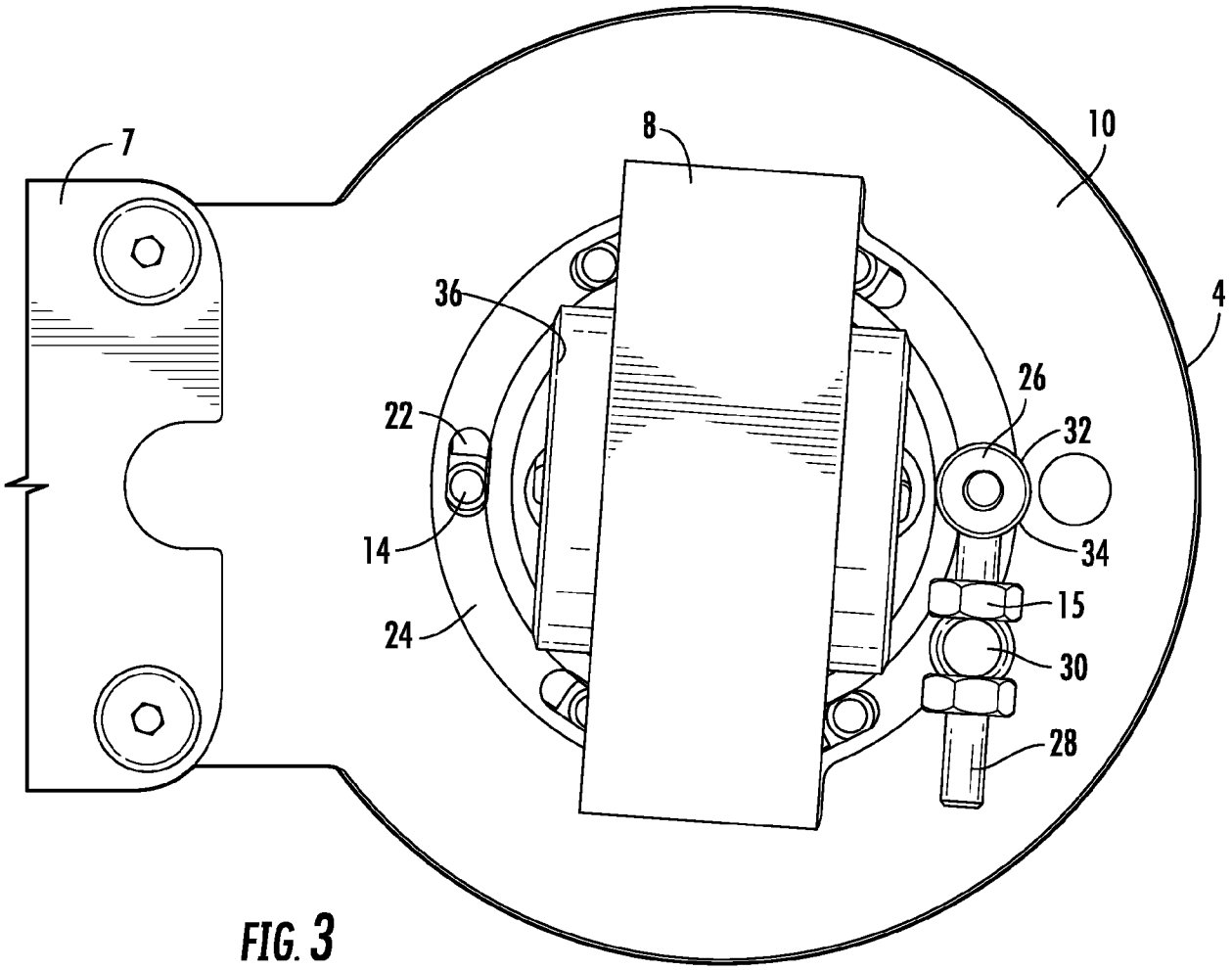
FIG. 3 is a close-up view of FIG. 2, the radio bracket adjusted +10 degrees, fastener heads removed for clarity.
Figure 4:
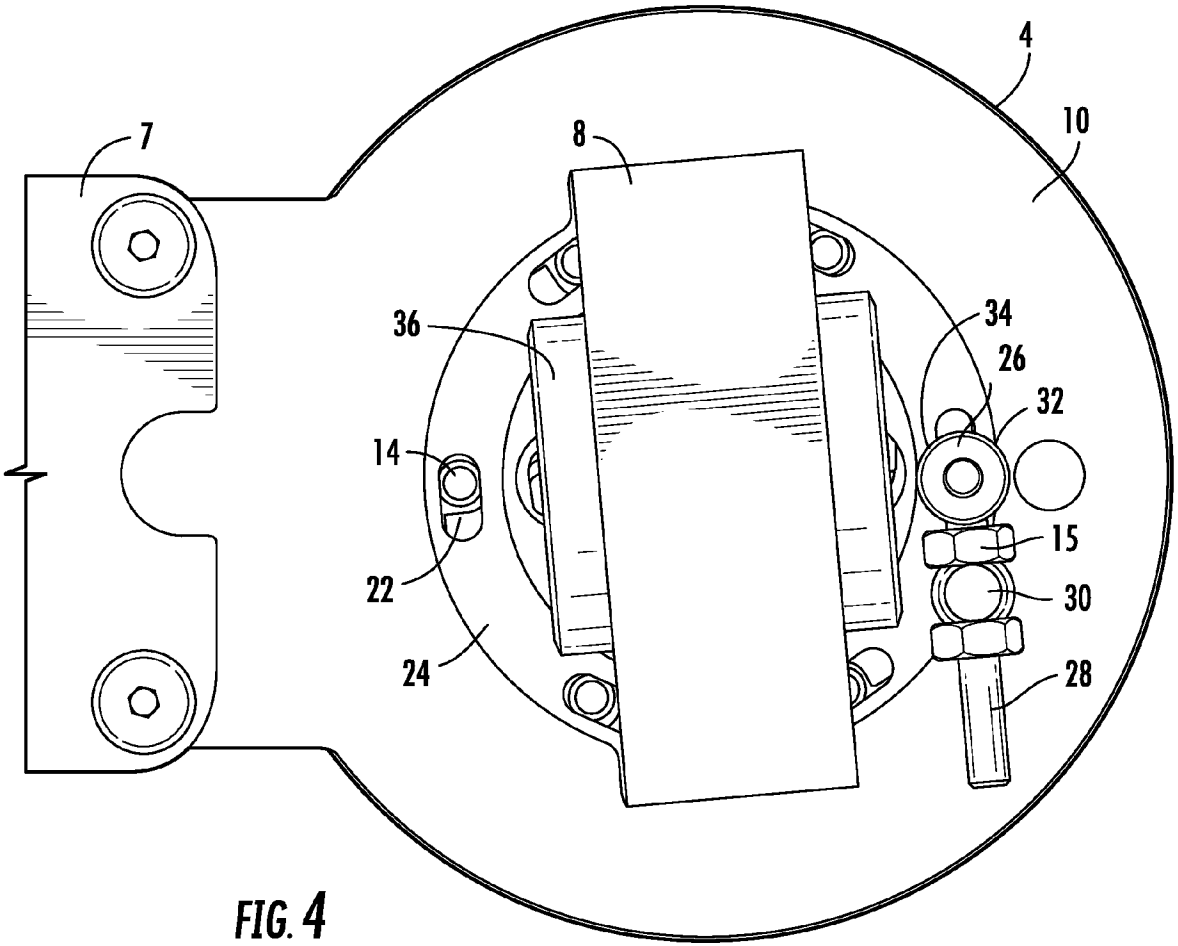
FIG. 4 is a close-up view of FIG. 2, the radio bracket adjusted −10 degrees, fastener heads removed for clarity.

The antenna feed (not shown) is coupled to a front side of the hub 10. A plurality of fasteners 14, for example bracket bolts, thread into corresponding mounting holes (not shown) provided on the back side of the hub 10. The fastener(s) 14 pass through a plurality of slot(s) 22 provided in a mounting flange 24 of a radio bracket 8 to couple the radio bracket 8 to the back side of the hub 10. The slot(s) 22 are preferably arcuate, with an arc radius about a center of the feed. Thereby, the radio bracket 8 may be rotated with respect to the hub 10 and the feed attached thereto within the extent of the slot(s) 22, for example for a range of plus or minus 10 degrees as shown in FIGS. 3 and 4.

The hub 10 may be formed with a stop portion 26, against which an adjustment bolt 28 abuts, the adjustment bolt 28 passing through a boss 30 coupled to, for example, the mounting flange 24. Alternatively, the stop portion 26 may be provided as an abutment 32 or the like of the hub 10 or coupled to the hub 10 by a stop portion fastener 34 passing therethrough. The stop portion fastener 34 supporting the stop portion 26 may also function as a mounting flange retaining fastener by also passing through one of the slots 22. As the adjustment bolt 28 is longitudinally displaced through the boss 30 and/or nuts 15 abutting the boss 30, for example by threading, the adjustment bolt 28 is driven against the stop portion 26, rotating the radio bracket 8 with respect to the hub 10.

A resolution of the radio bracket 8 rotation with respect to the hub 10 depends upon a thread pitch of the adjustment bolt 28, with a lower thread pitch providing a higher resolution. That is, for each turn of the adjustment bolt 28, the lower the thread pitch is, the smaller the longitudinal displacement driven by a single turn of the adjustment bolt 28.

Alternatively, the radio bracket 8 may be configured with the boss 30 and the stop portion 26 reversed. That is, it may be provided with a boss 30 coupled to the hub 10 and a stop portion 26 formed as a part of or coupled to the radio bracket 8.

The radio bracket 8 may further include an ortho mode transducer 36 aligned with the feed, providing polarized signal separation for radios such as transmitters and/or receivers also mounted to respective ports of the radio bracket 8. The desired transmitters and/or receivers may be mounted, for example via a radio adapter plate coupled to the radio bracket 8. The radio adapter plate may be configured for a desired radio bolt mounting pattern, simplifying radio bracket 8 inventory requirements and enabling easy exchange between radios of different manufacturers.

One skilled in the art will appreciate that the fine polarity adjustment performed while the reflector antenna 2 and/or hub 10 are fixed in place enabled by an arrangement according to the first embodiment has several advantages. Because loosening of the reflector antenna 2 and/or hub 10 is not required, boresight alignment is not disturbed during polarization fine adjustment. Also, because rotation of only the radio bracket 8 is required, the forces required for rotation of the radio bracket 8 are significantly reduced and any environmental and/or RF sealing between the feed 16 and the hub 10 and/or reflector 12 is undisturbed. Thereby application of finer threaded adjustment bolts 28 is enabled, resulting in higher resolution polarization adjustment. Further, adjustments may be quickly applied with reduced strain upon the installation personnel, without specialized tools.

Alternatively, the fine polarization adjustment may be performed with the radio bracket 8 rotationally interlocked with the feed, the rotation of the radio bracket 8 as described herein above also rotating the feed, for example where the feed waveguide structure 38 is integrated with an ortho mode transducer 36 providing rectangular waveguide outputs to the radio bracket 8.

Figure 5:
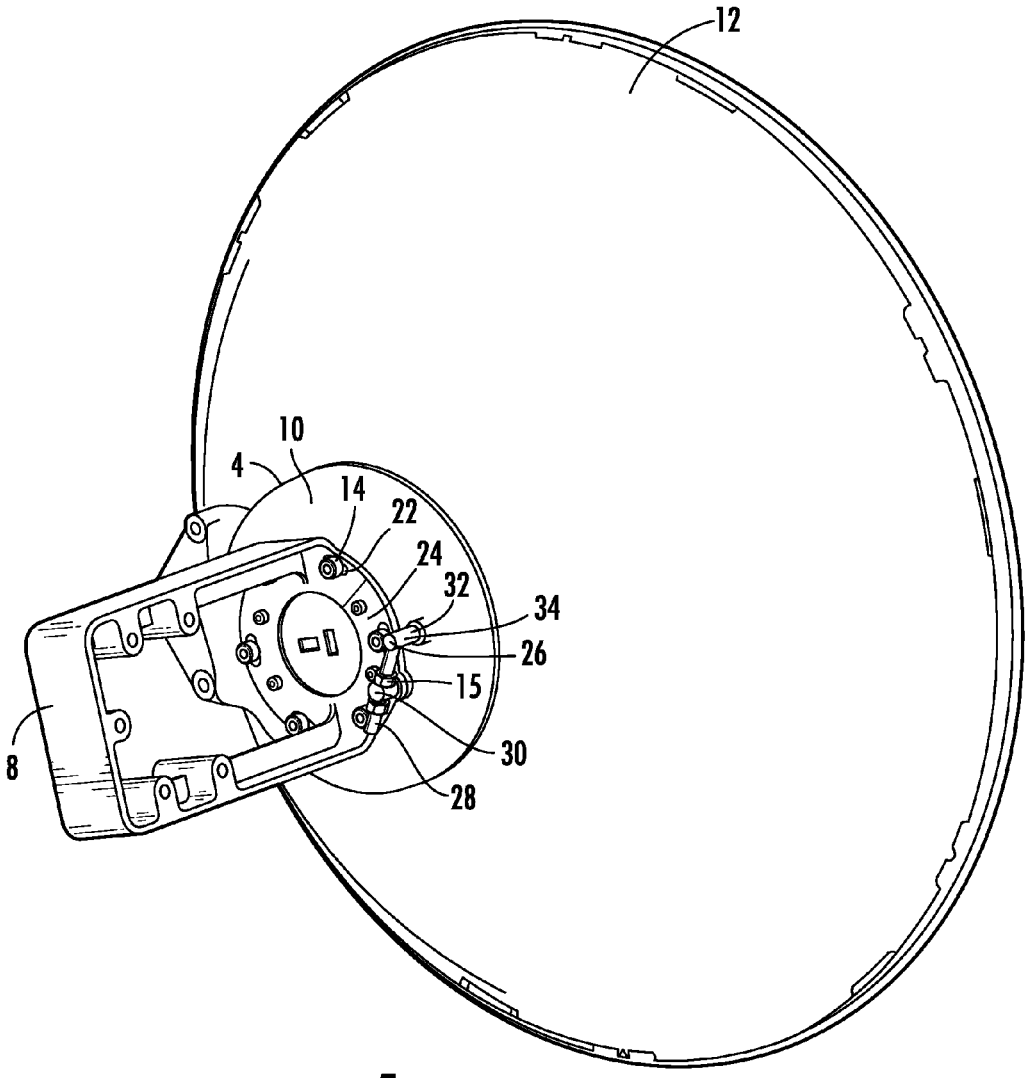
FIG. 5 is a schematic isometric angled back side view of a second embodiment of a reflector antenna.
Figure 6:
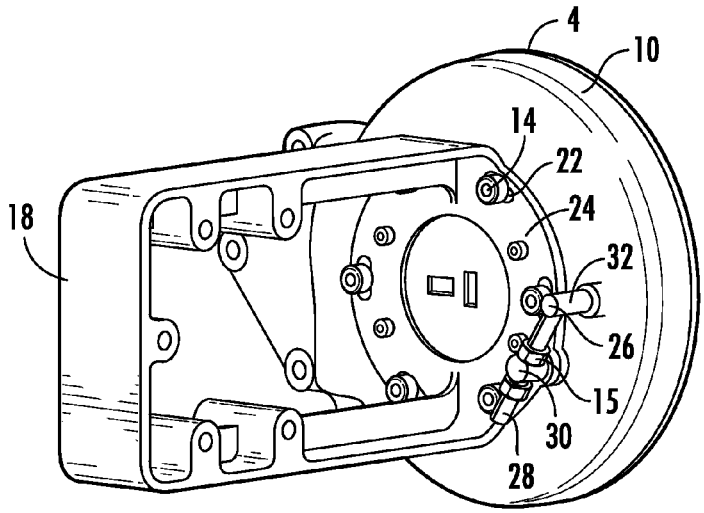
FIG. 6 is a close-up view of FIG. 5.
Figure 7:
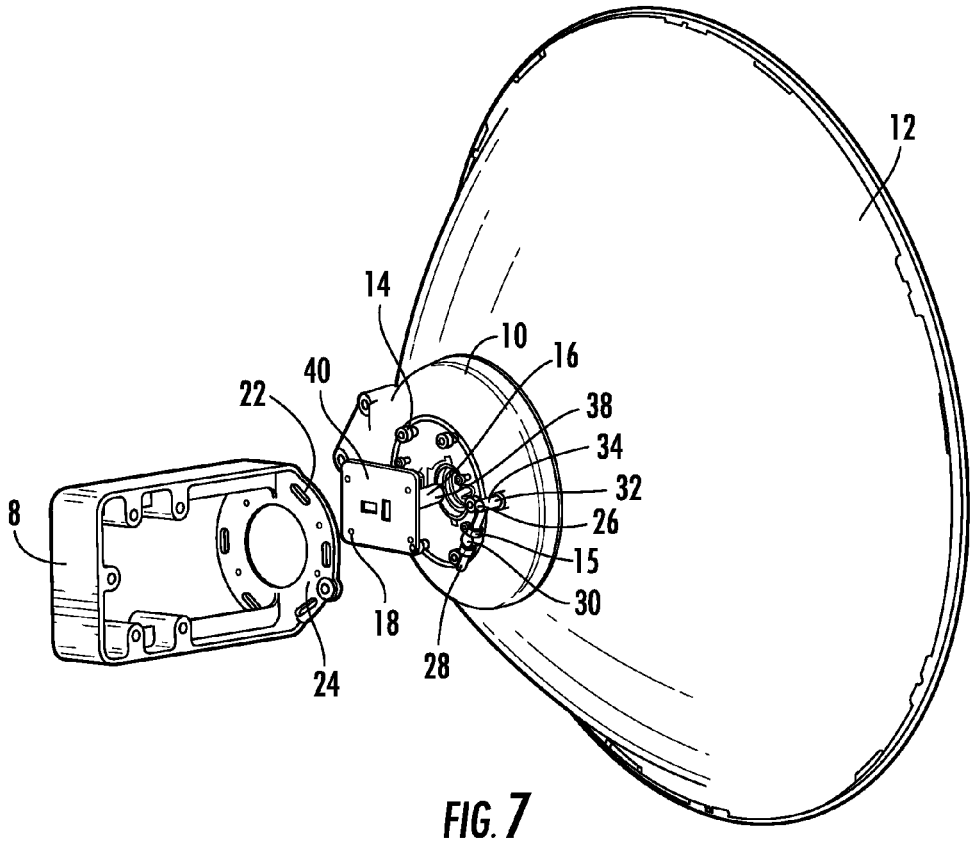
FIG. 7 is a schematic partially exploded isometric angled back side view of the reflector antenna of FIG. 5.

In a second embodiment, demonstrated in FIGS. 5-7, a reflector antenna 1 wherein the feed 16 is rotationally interlocked with the radio bracket 8 is provided with a fine polarization adjustment capability. Here the radio bracket 8 is directly interconnected, for example by a feed flange 40 coupled to the radio bracket 8, with and thereby rotationally interlocked with the feed 16, which passes through the hub 10 without being rotationally interlocked therewith. With the feed 16 rotationally interlocked with the radio bracket 8, polarization separation may occur prior to the radio bracket 8, for example via an ortho mode transducer 36 provided integral with the feed waveguide structure 38. The outputs of the ortho mode transducer 36 presenting outputs for each polarization to the radio bracket 8, aligned for routing to the respective radios mounted upon the radio bracket 8.

Similar to the first embodiment, a plurality of slots 22 are formed as part of the radio bracket 8 and a plurality of mounting holes 18 are provided on the back side of the hub 10 or other support structure of the reflector 12. The fasteners 14 pass through the slots 22 in the radio bracket 8 to couple the radio bracket 8 and feed 16 to the hub 10, rotatable within the extents of the slots 22. Also as described with respect to the first embodiment, fine polarization adjustment functionality is provided by a boss 30 supporting an adjustment bolt 28 abutting a stop portion 26, the boss 30 and the stop portion 26 each fixed to one of the radio bracket 8 and the hub 10, respectively.

In use, the reflector antenna 1 is mounted and boresighted via adjustments to the mounting bracket 7. A preliminary polarization alignment may be made by loosening the fasteners 14 and manually rotationally adjusting the radio bracket 8, for example with the aid of a bubble level. Fine polarization adjustment is then made either as a final fine adjustment with respect to the bubble level and/or according to communication link signal level feedback by adjusting the fasteners 14 to a degree sufficient to allow threading of the adjustment bolt 28 towards or away from the stop portion 26, thereby finely rotating the radio bracket 8, ortho mode transducer 36 and any radio equipment mounted thereon with respect to the hub 10. When the desired alignment is confirmed, the fasteners 14 are tightened, completing the adjustment procedure.

One skilled in the art will appreciate that the fine polarity adjustment performed while the reflector antenna 1 and/or hub 10 are fixed in place enabled by an arrangement according to the second embodiment may have several advantages. Because loosening of the reflector antenna 1 and/or hub 10 is not required, boresight alignment is not disturbed during polarization fine adjustment. Also, because rotation of only the radio bracket 8 is required, the forces required for rotation of the radio bracket 8 are significantly reduced. This enables application of finer threaded adjustment bolts 28, resulting in higher resolution polarization adjustment. Further, adjustments may be quickly applied with reduced strain upon the installation personnel, without specialized tools.

Table of Parts

| | |
|---|---|
| 2 | reflector antenna |
| 4 | polarization adjustment assembly |
| 6 | fixed mounting point |
| 7 | mounting bracket |
| 8 | radio bracket |
| 10 | hub |
| 12 | reflector |
| 14 | fastener |
| 15 | nut |
| 16 | feed |
| 18 | mounting hole |
| 22 | slot |
| 24 | mounting flange |
| 26 | stop portion |
| 28 | adjustment bolt |
| 30 | boss |
| 32 | abutment |
| 34 | stop portion fastener |
| 36 | ortho mode transducer |
| 38 | feed waveguide structure |
| 40 | feed flange |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A polarization adjustment assembly for a reflector antenna, comprising:

a radio bracket provided with a mounting flange with a plurality of slots;

a hub coupled to a reflector of the reflector antenna;

a stop portion provided on one of the mounting flange and the hub;

a plurality of fasteners coupling the radio bracket to the hub via the slots;

the slots dimensioned with an arc radius coaxial with an outer diameter of the hub and a boresight axis of the reflector antenna;

wherein the radio bracket is rotatable with respect to the hub about the boresight axis of the reflector antenna, within the extent of the slots.

2. The polarization adjustment assembly of claim 1, wherein the radio bracket is provided with an ortho mode transducer; the ortho mode transducer rotationally coupled with the hub.

3. The polarization adjustment assembly of claim 1, further including:

an adjustment bolt passing through a boss coupled to the mounting flange; and the adjustment bolt abutting the stop portion, the stop portion coupled to the hub, whereby longitudinal displacement of the adjustment bolt with respect to the boss rotates the radio bracket with respect to the hub coaxial with the boresight axis of the antenna.

4. The polarization adjustment assembly of claim 3, further including at least one nut abutting the boss, the nut threaded upon the adjustment bolt.

5. The polarization adjustment assembly of claim 3, wherein the stop portion is an abutment coupled to the hub via a stop portion fastener.

6. The polarization adjustment assembly of claim 5, wherein the stop portion fastener passes through one of the slots.

7. The polarization adjustment assembly of claim 1, further including an adjustment bolt passing through a boss coupled to the hub; and the stop portion is coupled to the mounting flange;

the adjustment bolt abutting the stop portion, whereby longitudinal adjustment of the adjustment bolt with respect to the boss rotates the radio bracket and a feed coupled to the radio bracket, with respect to the hub coaxial with the boresight axis of the antenna.

8. The polarization adjustment assembly of claim 7, wherein the feed is provided with an ortho mode transducer.

9. The polarization adjustment assembly of claim 7, further including at least one nut abutting the boss; the nut threaded upon the adjustment bolt.

10. The polarization adjustment assembly of claim 7, wherein the stop portion is an abutment coupled to the hub via a stop portion fastener.

11. The polarization adjustment assembly of claim 10, wherein the stop portion fastener passes through one of the slots.

12. A polarization adjustment assembly for a reflector antenna, comprising:

a radio bracket coupled to a feed passing through a hub;

the hub coupled to a reflector of the reflector antenna;

the radio bracket provided with a mounting flange with a plurality of slots.

a plurality of fasteners rotationally coupling the mounting flange to the hub via the slots;

an adjustment bolt passing through a boss coupled to the mounting flange; and a stop portion coupled to the hub;

the adjustment bolt abutting the stop portion, whereby longitudinal adjustment of the adjustment bolt with respect to the boss rotates the radio bracket with respect to the hub while the hub remains stationary, the rotation of the radio bracket coaxial with a boresight axis of the reflector antenna.

13. The polarization adjustment assembly of claim 12, wherein the feed is provided with an ortho mode transducer rotationally coupled with the hub.

14. The polarization adjustment assembly of claim 12, wherein the slots are dimensioned with an arc radius coaxial with an outer diameter of the hub.

15. The polarization adjustment assembly of claim 12, further including at least one nut abutting the boss; the nut threaded upon the adjustment bolt.

16. The polarization adjustment assembly of claim 12, wherein the stop portion is an abutment coupled to the hub via a stop portion fastener.

17. The polarization adjustment assembly of claim 16, wherein the stop portion fastener passes through one of the slots.

18. A method for adjusting polarization alignment of a reflector antenna, comprising the steps of:

loosening a plurality of fasteners rotationally coupling a radio bracket to a hub via a plurality of slots of the radio bracket; the hub coupled to a reflector of the reflector antenna;

coarse adjusting the orientation of the radio bracket to a desired preliminary polarization alignment by rotation of the radio bracket while the hub remains stationary, the rotation of the radio bracket coaxial with a boresight of the reflector antenna; and tightening the fasteners.

19. The method of claim 18, wherein after coarse adjusting the orientation, further including the step of fine adjusting the orientation of the radio bracket to a desired final polarization alignment by longitudinal displacement of an adjustment bolt with respect to a boss toward or away from a stop portion; the adjustment bolt passing through the boss; the adjustment bolt abutting the stop portion; the boss and the adjustment bolt respectively coupled to one of the hub and the radio bracket.

* * * * *